US012523444B2

(12) United States Patent
Ivgi

(10) Patent No.: US 12,523,444 B2
(45) Date of Patent: Jan. 13, 2026

(54) HANDGUN HOLSTER WITH RETENTION MECHANISM

(71) Applicant: Orpaz Defense Ltd., Rosh HaAyin (IL)

(72) Inventor: Simon Ivgi, Herzliya (IL)

(73) Assignee: Orpaz Defense Ltd., Rosh HaAyin (IL)

( * ) Notice: Subject to any disclaimer, the term of this patent is extended or adjusted under 35 U.S.C. 154(b) by 102 days.

(21) Appl. No.: 18/412,723

(22) Filed: Jan. 15, 2024

(65) Prior Publication Data

US 2024/0247909 A1 Jul. 25, 2024

(51) Int. Cl.
*F41C 33/02* (2006.01)

(52) U.S. Cl.
CPC ..... *F41C 33/0263* (2013.01); *F41C 33/0254* (2013.01)

(58) Field of Classification Search
CPC ..... F41C 33/0263; F41C 33/0254
See application file for complete search history.

(56) References Cited

U.S. PATENT DOCUMENTS 8,132,355 B1 * 3/2012 Kincaid ..... F41G 1/35 403/374.5
10,393,477 B1 * 8/2019 Kincaid ..... F41C 33/0263
2006/0157520 A1 * 7/2006 Clifton ..... F41C 33/0245 224/193
2009/0014484 A1 * 1/2009 Spielberger ..... F41C 33/0263 224/244
2009/0294496 A1 * 12/2009 Gallagher ..... F41C 33/0209 224/243
2011/0174849 A1 * 7/2011 Clifton, Jr. ..... F41C 33/0263 224/243
2011/0174850 A1 * 7/2011 Clifton, Jr. ..... F41C 33/0209 224/243
2013/0306691 A1 * 11/2013 Baumann ..... F41C 33/0263 224/244

* cited by examiner

*Primary Examiner* — Derek J Battisti
(74) *Attorney, Agent, or Firm* — Dekel Patent Ltd.; David Klein

(57) ABSTRACT

A holster includes a holster housing having an opening for inserting therethrough a weapon, a retention release lever including a shaft that has a pusher member and an inclined surface, and a holster retention tab pivotally coupled to the holster housing by a pivot element. The holster retention tab includes a catch, which lockingly engages an ejection port of the weapon when the weapon is inserted into the holster housing, and a force inclined surface. A biasing device is mounted in the holster housing to apply an urging force on the holster retention tab so as to retain the catch in the ejection port when the weapon is inserted into the holster housing. The inclined surface pushes against the force inclined surface, thereby creating a force vector that causes the holster retention tab to pivot about the pivot element and overcome the urging force of the biasing device and release the catch from the ejection port.

9 Claims, 6 Drawing Sheets

HANDGUN HOLSTER WITH RETENTION MECHANISM

FIELD OF THE INVENTION

The present invention relates to handgun holsters with a retention mechanism.

BACKGROUND OF THE INVENTION

Many users of handguns, particularly military and law enforcement personnel, carry a handgun in a holster designed to protect the handgun and hold it securely. Holsters can be worn in a number of ways, such as on a belt at the waist, on the thigh, under an arm, or around an ankle.

Some holsters include a variety of strap or flap arrangements that prevent the removal of the firearm from the holster while the strap or flap is in place. The user must first unfasten and/or rotate the strap/flap before the firearm can be withdrawn. To re-secure the handgun in the holster once the handgun has been re-holstered, the user must physically refasten and/or rotate the strap/flap before the firearm is securely retained within the holster. Some users might not prefer these designs because of the time required to release and/or re-secure the handgun.

Accordingly, a user-friendly holster retention mechanism is needed.

SUMMARY

The present invention seeks to provide user-friendly holster retention mechanism, as is described more in detail hereinbelow.

There is thus provided in accordance with a non-limiting embodiment of the invention a holster including a holster housing having an opening for inserting therethrough a weapon, a retention release lever including a shaft that has a pusher member and an inclined surface, a holster retention tab pivotally coupled to the holster housing by a pivot element, the holster retention tab including a catch, configured to lockingly engage an ejection port of the weapon when the weapon is inserted into the holster housing, and a force inclined surface (the catch and the force inclined surface may be positioned on opposite sides of the pivot element), and a biasing device mounted in the holster housing and configured to apply an urging force on the holster retention tab so as to retain the catch in the ejection port when the weapon is inserted into the holster housing, wherein the inclined surface of the shaft is arranged to push against the force inclined surface of the holster retention tab, thereby creating a force vector that causes the holster retention tab to pivot about the pivot element and overcome the urging force of the biasing device and release the catch from the ejection port.

In accordance with a non-limiting embodiment of the invention the shaft is formed with a slot along a length thereof, and a pin or screw is received in the slot, such that movement of the retention release lever is guided and limited by the pin or screw as the slot moves with respect to the pin or screw.

In accordance with a non-limiting embodiment of the invention a weapon retention wedge assembly is provided which includes a movable wedge member and an adjustment screw configured to advance or retract the movable wedge member to adjust a wedging force against the weapon when holstered in the holster housing.

In accordance with a non-limiting embodiment of the invention the holster housing includes an extension for holstering a weapon equipped with an illumination device.

In accordance with a non-limiting embodiment of the invention an illumination device cover is coupled to the holster housing.

BRIEF DESCRIPTION OF DRAWINGS

The present invention will be understood and appreciated more fully from the following detailed description, taken in conjunction with the drawings in which.

DETAILED DESCRIPTION

Figure 1:
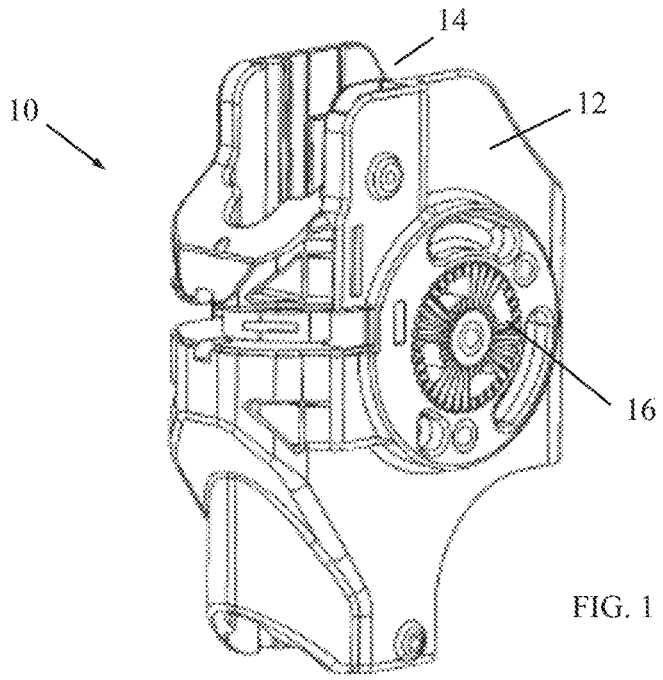
FIG. 1 is a simplified perspective illustration of a holster, in accordance with a non-limiting embodiment of the present invention.
Figure 2:
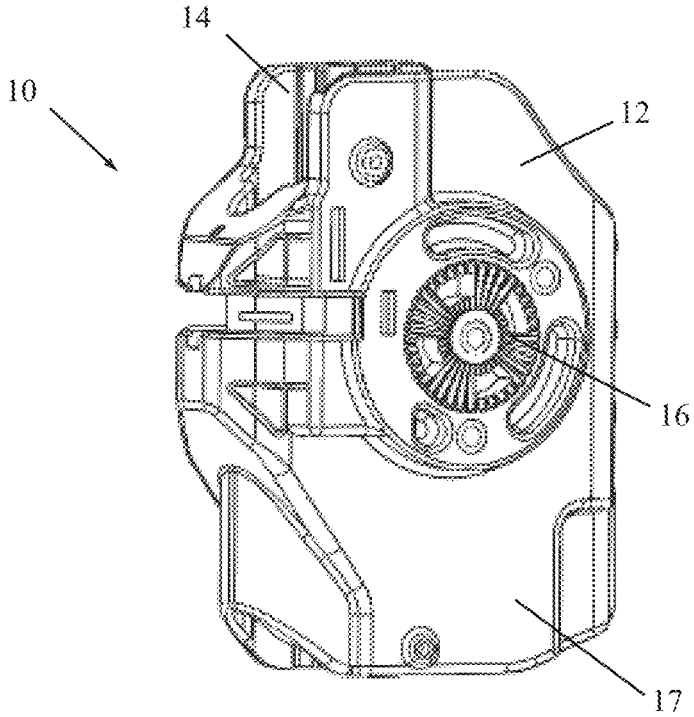
FIG. 2 is a simplified perspective illustration of the holster, in accordance with a non-limiting embodiment of the present invention, with an extension for holstering a weapon equipped with an illumination device, such as a laser light aiming device.

Reference is now made to FIGS. 1 and 2, which illustrate a holster 10, in accordance with a non-limiting embodiment of the present invention.

Holster 10 may include a holster housing 12, made of any suitable holster material, such as but not limited to, a polymer, such as KYDEX (thermoplastic acrylic-polyvinyl chloride). The holster housing 12 has an opening 14 for inserting therethrough a handgun or other weapon (not shown). The holster housing 12 may include a paddle hub 16 (which may be serrated), or any other garment attachment means, as is known in the art.

FIG. 2 illustrates the holster 10 with an extension 17 for holstering a weapon equipped with an illumination device, such as a laser light aiming device (not shown).

Figure 3:
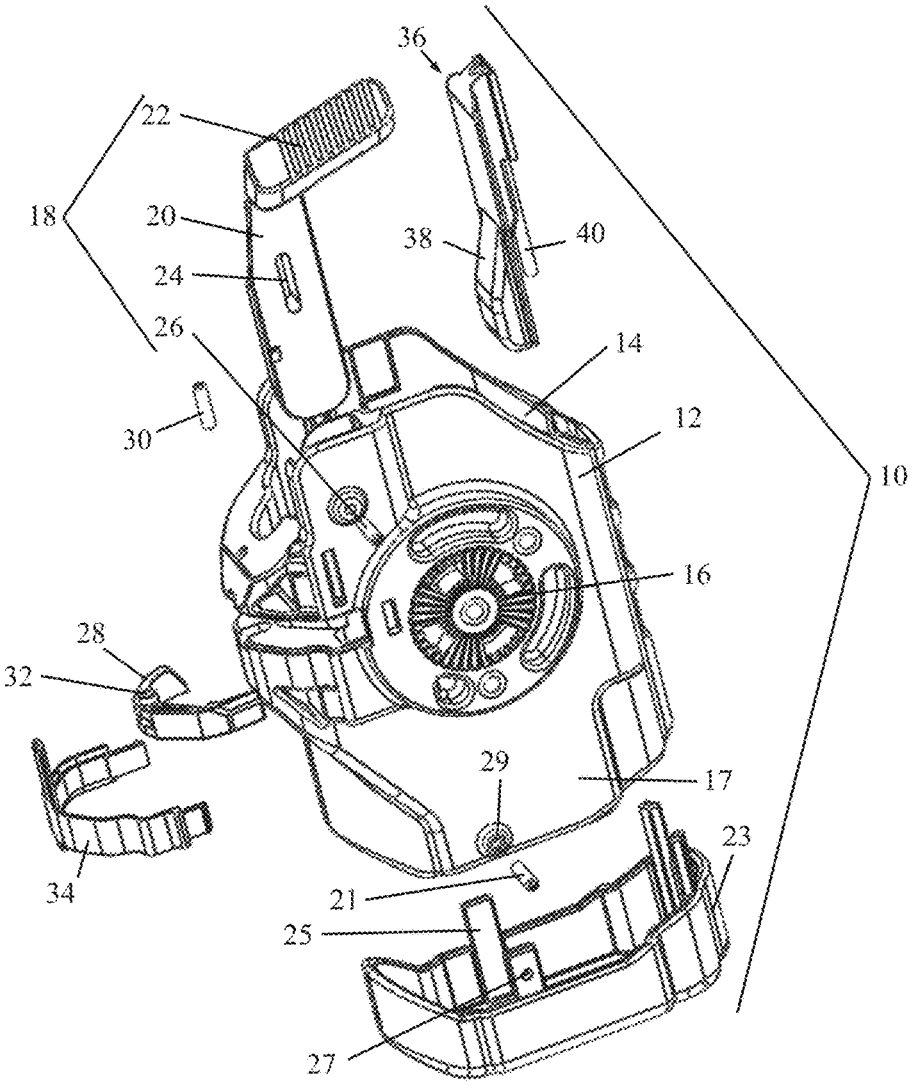
FIG. 3 is an exploded illustration of the holster, including a retention release lever and a weapon retention wedge assembly.

Reference is now made to FIG. 3. Holster 10 may include a retention release lever 18, which may include a shaft 20 from which extends a pusher member 22 (which may be serrated or knurled), which may be tilted with respect to shaft 20 at an angle different from 90° (or optionally 90°). Shaft 20 may be formed with a slot 24 along a length thereof. A pin or screw 26 may be received in slot 24. Accordingly, retention release lever 18 may be pushed downward (in the sense of the drawings), by pushing down on pusher member 22 (with the thumb or other finger of the shooter), and the downward movement of retention release lever 18 is guided and limited by pin 26 as slot 24 moves with respect to pin 26.

The retention release lever 18 actuates (as is explained below) a holster retention tab 28, which may be pivotally coupled to holster housing 12 by a pivot element 30 (e.g., pin or screw), which passes through a pivot hole 32 formed on holster retention tab 28. A holster retention tab cover 34 may be provided that is mounted on holster housing 12 adjacent the holster retention tab 28.

FIG. 3 shows the holster version of FIG. 2 with extension 17 for holstering a weapon equipped with an illumination device. In such an embodiment, the holster may include an illumination device cover 23, which can be coupled to holster housing 12, such as but not limited to, by snap bars 25, which snap fit into the bottom opening of holster housing 12, and which may be secured by a fastener (or fasteners) 21, such as a screw, which may passes through a mounting hole 27 in one of the snap bars 25 and a (e.g., threaded) hole 29 in holster housing 12. The illumination device cover 23 can serve as a flashlight protector cap that protects the flashlight or other illumination device and prevents light leak during duty use.

Holster 10 may include a weapon retention wedge assembly 36, including a movable wedge member 38 and an adjustment screw 40 which can advance or retract the movable wedge member 38 to adjust the wedging force the movable wedge member 38 applies to a weapon holstered in the holster 10. In this manner, the user can adjust the retention force applied to the weapon and the force required to draw the weapon from the holster. The weapon retention wedge assembly 36 is particularly useful as a modular flashlight adapter system that allows a customized fit for multiple flashlights or even using the holster without any flashlight. The weapon retention wedge assembly 36 accommodates different types of flashlights or other illumination devices and ensures a secure and comfortable carry for any situation.

Figure 4:
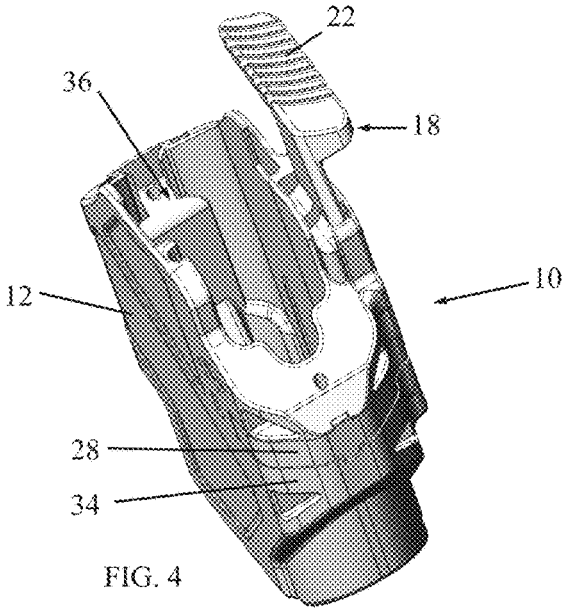
FIG. 4 is a perspective illustration of the holster with the retention release lever and weapon retention wedge assembly.

FIG. 4 is a perspective illustration of the holster 10 with the retention release lever 18 and weapon retention wedge assembly 36.

Figure 5:
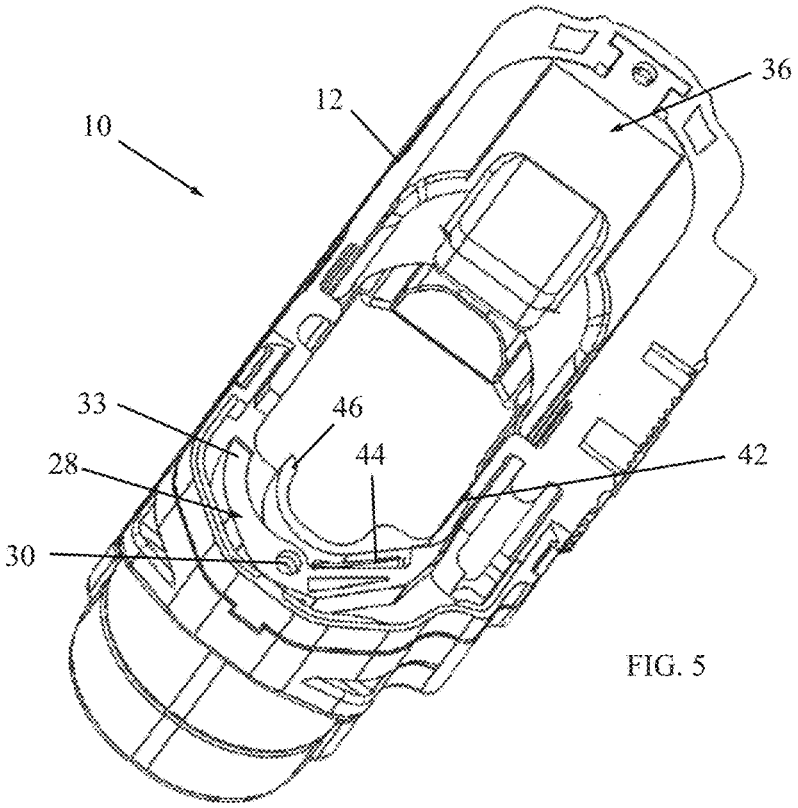
FIG. 5 is a cutaway perspective illustration of the holster showing the position of a holster retention tab, its pivot, its return biasing device, and the weapon retention wedge assembly mounted in the holster.
Figure 6:
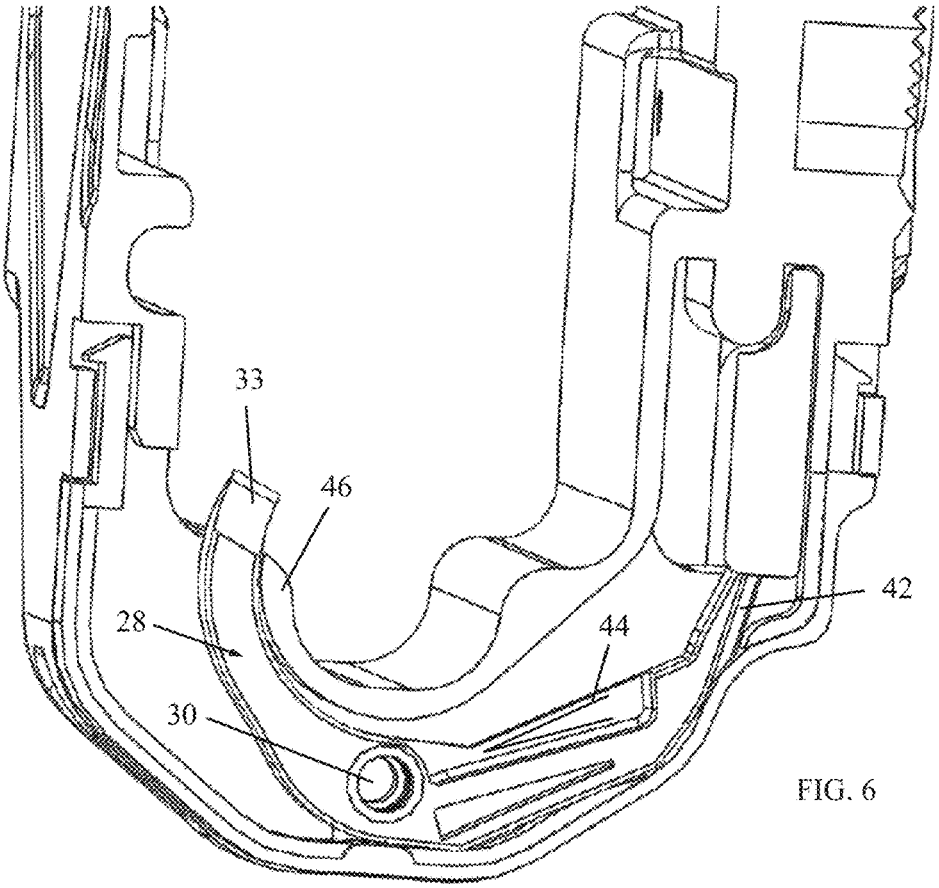
FIG. 6 is an enlarged view of the position of the holster retention tab, its pivot, and its return biasing device.

Reference is now made to FIGS. 5 and 6. The holster retention tab 28 pivots about pivot element 30 and has a catch 33, which can lockingly engage an ejection port of a weapon (as described below). As is shown more in detail below, holster retention tab 28 includes a force inclined surface 42, which is pushed by the retention release lever so that holster retention tab 28 pivots about pivot element 30. A biasing device 44 (e.g., a leaf spring), which is best seen in FIG. 6, may provide an urging force on holster retention tab 28 to retain the holster retention tab 28 in the ejection port of the weapon, as long as the retention release lever is not pushed to release the holster retention tab 28 from the ejection port. The force inclined surface 42 (and optionally the biasing device 44) is positioned on one side of pivot element 30 and the catch 33 is positioned on the opposite side of pivot element 30. When catch 33 of holster retention tab 28 is retained in the ejection port of the weapon, catch 33 may rest against a curved surface 46 formed in holster housing 12.

Figure 9:
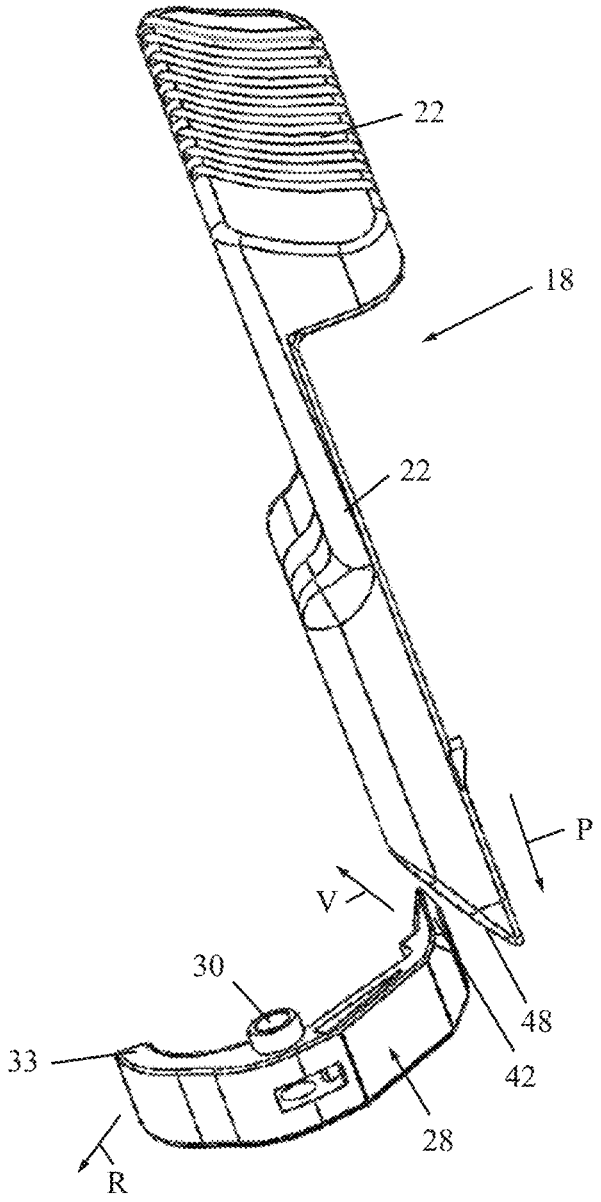
FIG. 9 is an enlarged perspective illustration of the retention release lever and the holster retention tab.

Reference is now made to FIG. 9. The distal end of the shaft 20 of retention release lever 18 has an inclined surface 48 which is arranged to push against the force inclined surface 42 of holster retention tab 28. The downward pushing force P of retention release lever 18 creates a force vector V due to the abutting of inclined surface 48 on force inclined surface 42. This force vector V is directed in a direction R that causes holster retention tab 28 to pivot about pivot element 30 to release catch 33 from the ejection port (not shown). Force vector V is greater than, and thus overcomes, the opposite force provided by biasing device 44 to allow release of catch 33.

Figure 7:
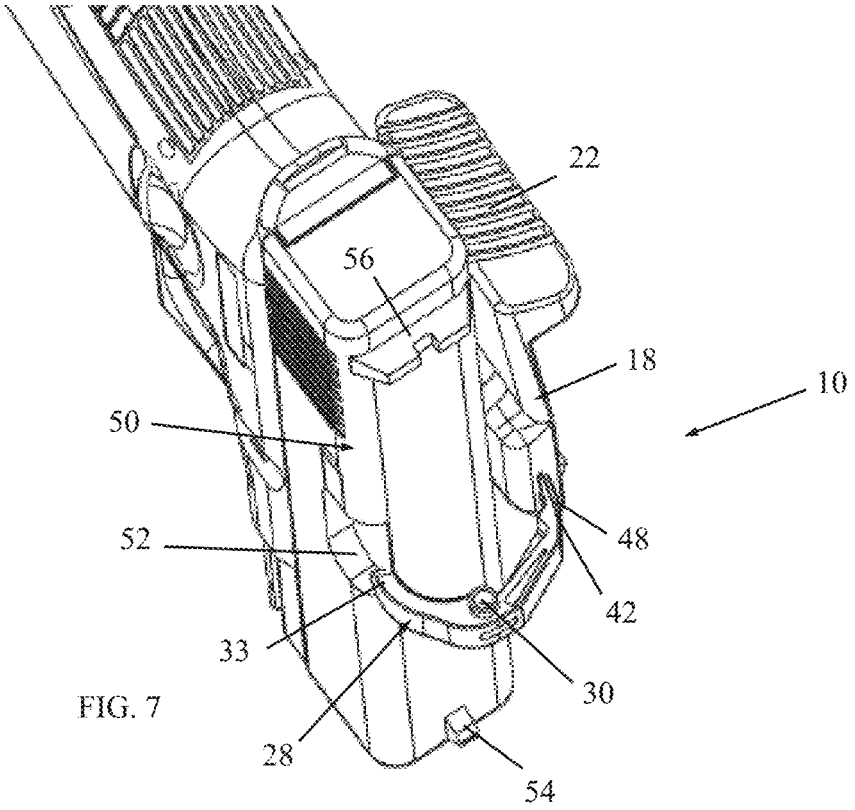
FIGS. 7 and 8 are simplified perspective illustrations of the holster with the holster retention tab in respective locked and unlocked positions on the ejection port of the weapon.
Figure 8:
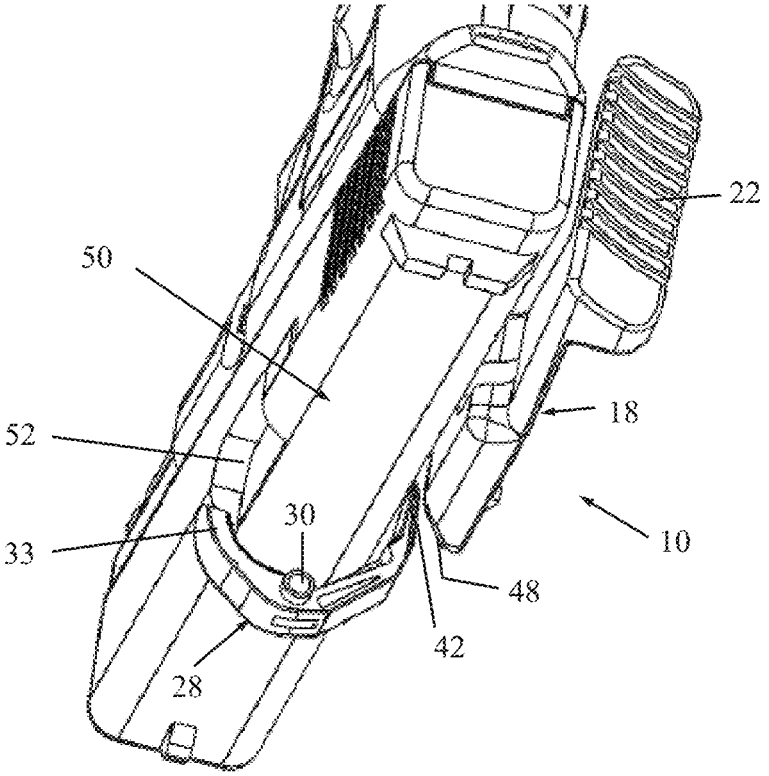

Reference is now made to FIGS. 7 and 8, which illustrate holster 10 with holster retention tab 28 in respective locked and unlocked positions on an ejection port 52 of a weapon 50. (FIG. 7 shows the front and rear sights 54 and 56, respectively, of the weapon 50.) As long as the user applies the downward pushing force P on retention release lever 18, catch 33 remains released from the ejection port and the weapon can be drawn from the holster. The user can easily re-holster the weapon by simply placing the weapon back into the holster, which action overcomes the force provided by biasing device 44 to allow release of catch 33 and re-holstering of the weapon. Once the weapon is fully inserted in the holster, biasing device 44 urges catch 33 back against the ejection port with an audible click so the user is assured that the weapon is properly holstered.

Figure 10:
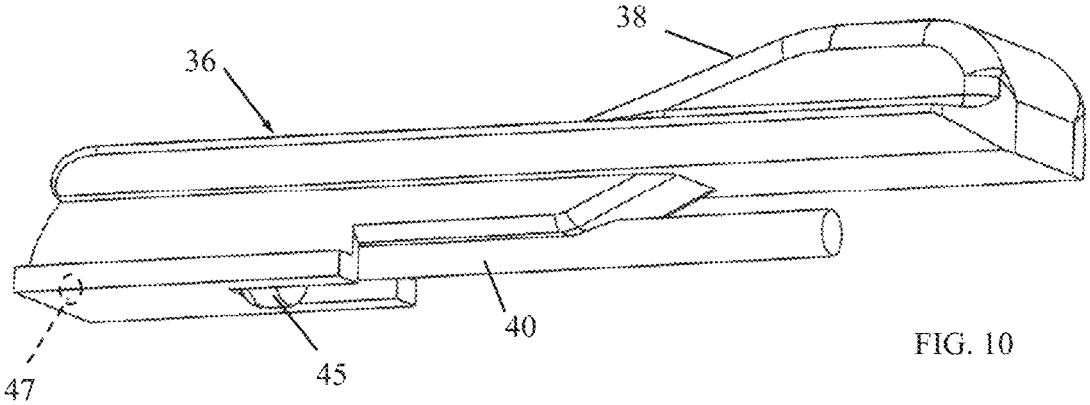
FIG. 10 is an enlarged perspective illustration of the weapon retention wedge assembly.
Figure 11:
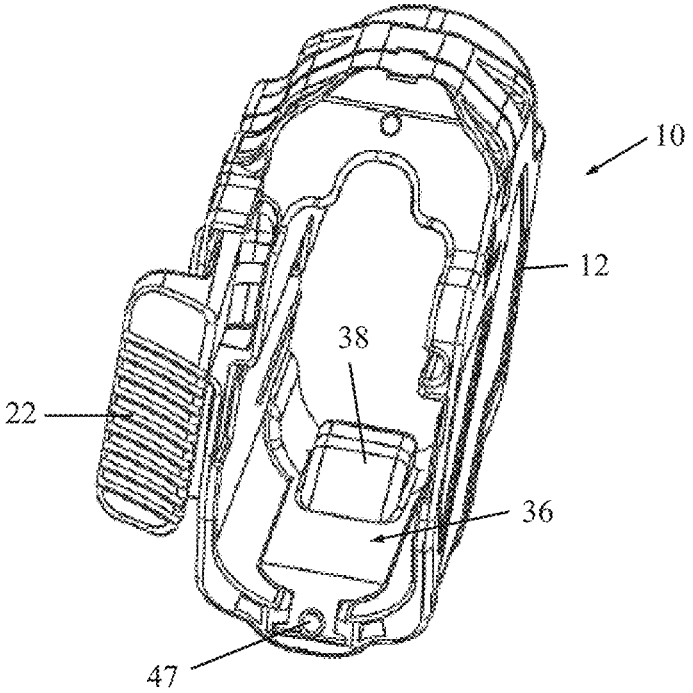
FIG. 11 is a perspective illustration of the holster showing the positions of the weapon retention wedge assembly and the retention release lever.

Reference is now made to FIG. 10, which illustrates the weapon retention wedge assembly 36, and to FIG. 11, which illustrates the holster 10 showing the positions of the weapon retention wedge assembly 36 and the retention release lever 18. An access port 47 is provided for a screwdriver or similar tool to gain access to the head 45 (FIG. 10) of adjustment screw 40.

The invention claimed is:

1. A holster comprising: a holster housing having an opening for inserting therethrough a weapon; a retention release lever comprising a shaft that has a pusher member and an inclined surface; a holster retention tab pivotally coupled to said holster housing by a pivot element, said holster retention tab comprising a catch, configured to lockingly engage an ejection port of the weapon when the weapon is inserted into said holster housing, and a force inclined surface; and a biasing device mounted in said holster housing and configured to apply an urging force on said holster retention tab so as to retain said catch in the ejection port when the weapon is inserted into said holster housing; wherein said inclined surface of said shaft is arranged to push against said force inclined surface of said holster retention tab, thereby creating a force vector that causes said holster retention tab to pivot about said pivot element and overcome the urging force of said biasing device and release said catch from the ejection port, and wherein said inclined surface is a flat surface.

2. The holster according to claim 1, wherein said catch and said force inclined surface are positioned on opposite sides of said pivot element.

3. The holster according to claim 1, wherein said shaft is formed with a slot along a length thereof, and a pin or screw is received in said slot, such that movement of said retention release lever is guided and limited by said pin or screw as said slot moves with respect to said pin or screw.

4. The holster according to claim 1, further comprising a weapon retention wedge assembly which comprises a movable wedge member and an adjustment screw configured to advance or retract said movable wedge member to adjust a wedging force against the weapon when holstered in said holster housing.

5. The holster according to claim 1, wherein said holster housing comprises an extension for holstering a weapon equipped with an illumination device.

6. The holster according to claim 1, wherein an illumination device cover is coupled to said holster housing.

7. The holster according to claim 4, wherein said weapon retention wedge assembly is a modular flashlight adapter system that allows a customized fit for multiple illumination devices or with no illumination device.

8. The holster according to claim 1, wherein said inclined surface is formed on an external distal end of said shaft.

9. The holster according to claim 1, wherein said shaft and said inclined surface of said shaft are constrained to move in a straight, non-rotational direction.

* * * * *